United States Patent [19]

Asanuma et al.

[11] Patent Number: 4,464,985

[45] Date of Patent: Aug. 14, 1984

[54] PRESSING ROLLER DRIVE DEVICE

[75] Inventors: Tetsu Asanuma, Saitama; Tsutomu Miura, Kanagawa, both of Japan

[73] Assignee: Fuji Xerox Co., Ltd., Tokyo, Japan

[21] Appl. No.: 404,735

[22] Filed: Aug. 3, 1982

[30] Foreign Application Priority Data

Aug. 3, 1981 [JP] Japan ..... 56-122323

[51] Int. Cl.[3] ..... B30B 14/00; B30B 12/00

[52] U.S. Cl. ..... 100/47; 100/172; 100/176; 100/168; 68/258; 68/253 R; 355/3 FU

[58] Field of Search ..... 100/47, 172, 168, 176; 68/258, 256, 262 R, 253 R; 432/60; 219/216, 469; 355/3 FU

[56] References Cited

U.S. PATENT DOCUMENTS 3,331,592 7/1967 Cassano et al. ..... 100/172 X

FOREIGN PATENT DOCUMENTS 2652731 5/1977 Fed. Rep. of Germany ... 355/3 FU

*Primary Examiner*—Peter Feldman

*Attorney, Agent, or Firm*—Sughrue, Mion, Zinn, Macpeak and Seas

[57] ABSTRACT

A drive device for relatively moving a fixing roller and a pressing roller of a copier employs a one-way clutch to brake the rotation of a cam shaft in moving the pressing roller from the fixing roller so as to avoid abrupt rotation of the cam shaft and the attendant noise and possible damage.

6 Claims, 3 Drawing Figures

PRESSING ROLLER DRIVE DEVICE

BACKGROUND OF THE INVENTION

This invention relates to a fixing unit in a copying machine, and more particularly to a device for driving a pressing roller in the fixing unit.

In general, in a fixing unit of a copying machine, and especially in a fixing unit using a fixing roller and a pressing roller, the fixing roller and the pressing roller are brought into contact with each other so that toner transferred onto an image supporting sheet is made molten and is fixed by the heat of a heater incorporated in the fixing roller and the nipping pressure of these two rollers. If the fixing roller and the pressing roller are maintained in contact with each other as described above, then an elastic part which forms the surface of the pressing roller may be deformed by being heated. Furthermore, toner offset onto the fixing roller may then be offset to the pressing roller, which may spoil the back side of the next sheet. In order to overcome these difficulties, a sensor is provided near the fixing roller so as to detect when sheets go into and leave the fixing roller. In response to a detection signal from the sensor, the pressing roller is moved into and out of engagement with the fixing roller.

The operation of moving the pressing roller into and out of engagement with the fixing roller is carried out by a pressing roller drive device. A conventional pressing roller drive device comprises an arm coupled to the pressing roller; an eccentric cam for moving the arm up and down; a spring clutch for selectively transmitting the drive force of a motor to the cam shaft of the eccentric cam; and a solenoid for periodically energizing the clutch. The spring clutch has two pawls, one of which is engaged with the end of a pivotally operating arm, the other end of which is coupled to the solenoid. When the pivotally operating arm is in engagement with the pawl, the pressing roller is in contact with the fixing roller or is set apart from the latter. In this case, the drive force of the motor is not transmitted to the cam shaft, and therefore the cam is at rest. Upon energization of the solenoid the arm is disengaged from the pawl, as a result of which the spring clutch engages the cam shaft to transmit the motor's drive force, to thereby turn the cam shaft. Therefore, the cam is turned to move the pressing roller vertically. Since the solenoid is energized only momentarily, after the spring clutch turns through 180°, the arm is engaged with the next pawl. That is, whenever the cam makes a half revolution, the pressing roller is moved into and out of engagement with the fixing roller.

However, in the above-described pressing roller drive device, in separating the pressing roller from the fixing roller the fixing roller reacts on the pressing roller so that the speed of rotation of the cam shaft becomes higher than that of the motor and the arm cannot sufficiently follow the cam surface of the eccentric cam, with the result that the arm drops onto the cam surface abruptly, thus generating a large impact noise.

SUMMARY OF THE INVENTION

Accordingly, an object of this invention is to improve a conventional pressing roller drive device, to thereby prevent the occcurrence of such impact noise.

The foregoing object and other objects of the invention have been achieved by the provision of a device for driving a pressing roller, which includes an arm coupled to the rotary shaft of the pressing roller; an eccentric cam for moving the arm vertically; clutch means for transmitting drive power from a drive source to the cam shaft of the eccentric cam and interrupting the transmission of drive power; and means for periodically energizing the clutch means, in which, according to the invention, a one-way clutch is coupled to the cam shaft. In other words, a drive gear driven by the drive source is rotatably mounted on the cam shaft, the spring clutch is interposed between the drive gear and the cam shaft, and the one-way clutch is provided in such a manner that it is turned together with the drive gear, whereby the over-running of the cam is prevented such that the cam shaft turns faster than the drive gear because of a force applied to the shaft when the pressing roller is separated from the fixing roller. More specifically, when the spring clutch is not in engagement with the drive gear, the one-way clutch turns freely. When the spring clutch engages the drive gear, the cam shaft turns faster than the drive gear owing to the force applied to the cam shaft. Accordingly, the one-way clutch and the cam shaft are turned such that the one-way clutch is engaged with the cam shaft to brake the rotation of the cam shaft.

On the other hand, in the case when the pressing roller, which has been set apart from the fixing roller, is brought into contact therewith, no braking force is applied because the drive gear, the spring clutch, the cam shaft and the one-way clutch are turned at the same speed.

DETAILED DESCRIPTION OF THE PREFERRED EMBODIMENTS

Figure 1:
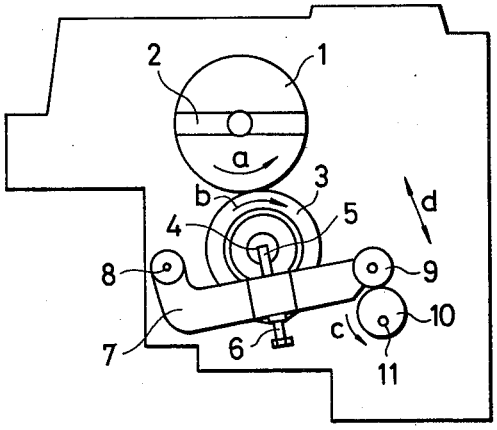
FIG. 1 is an explanatory diagram outlining a fixing unit using a pressing roller drive device according to this invention.

FIG. 1 shows one example of a fixing unit of a copying machine. In FIG. 1, reference numerals 1 and 3 designate a fixing roller and a pressing roller, respectively. The fixing roller incorporates a heater 2 and is turned in the direction of the arrow a. The pressing roller 3, being in contact with the fixing roller 1, is turned in the direction of the arrow b. An adjusting rod 5 is coupled to the rotary shaft 4 of the pressing roller 3. The adjusting rod 5 is further coupled to an arm 7 in such a manner that the distance between the arm and the rotary shaft 4 can be adjusted with an adjusting screw 6. The arm 7 is pivotally mounted on a rod 8 at one end and has a cam follower 9 at the other end. The cam follower 9 moves following the cam surface of an eccentric cam 10. The cam 10 is turned in the direction of the arrow c by a drive mechanism to be described later. The arm 7 is moved up and down as indicated by the arrow d, and therefore the pressing roller 3 is moved into and out of engagement with the fixing roller 1.

Figure 2:
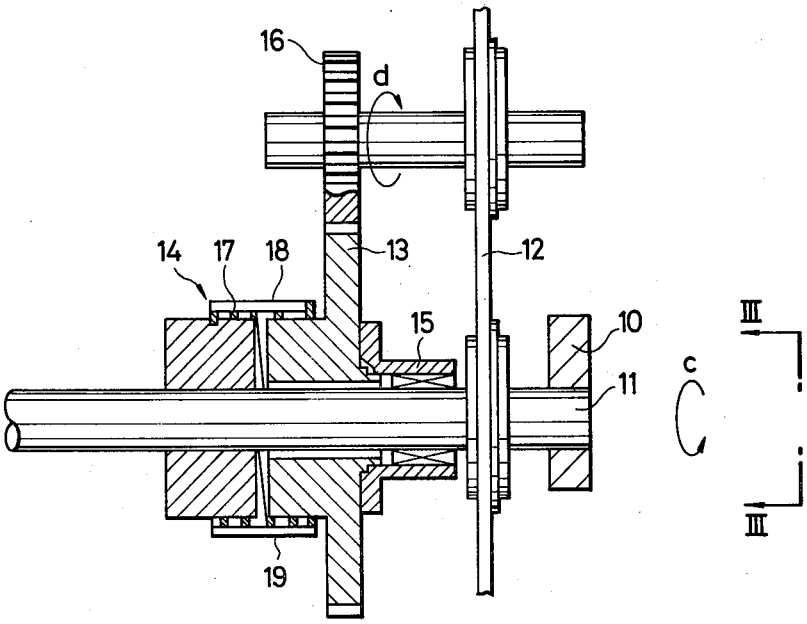
FIG. 2 is a sectional view showing a part of the pressing roller drive device according to the invention.

Now, the driving of cam 10 will be described. As shown in FIG. 2, the cam 10 is mounted on a cam shaft 11 and is turned in the direction of the arrow c, or counterclockwise. The cam shaft 11 is rotatably mounted on the frame 12 of the fixing unit by means of bearings. A drive gear 13 for turning the cam shaft 11 in the direction of the arrow c is mounted on the cam shaft 11. A spring clutch 14 for transmitting the power of the drive gear 13 to the shaft is mounted on the cam shaft 11. A one-way clutch 15 is coupled to the drive gear 13 so that it is turned together with the drive gear 13 in the direction of the arrow c, or counterclockwise. The drive gear 13 is engaged with a gear 16, which is therefore turned in the direction of the arrow d, or clockwise, by a motor (not shown).

Figure 3:
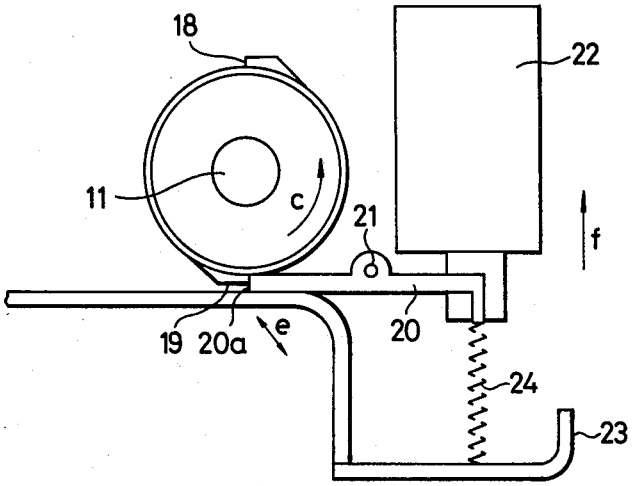
FIG. 3 is a side view taken along the direction of the arrows III—III in FIG. 2, showing a spring clutch.

FIG. 3 is a side view taken along the direction of the arrows III—III in FIG. 2, showing the spring clutch 14. As is apparent from FIGS. 2 and 3, the spring clutch 14 operates to couple the drive gear 13 to the cam shaft 11 with the aid of the tightening force of a spring 17. This coupling is released by depressing either of two pawls 18 and 19 of a spring shaft in the tangential direction as shown in FIG. 3. The pawls 18 and 19 are energized by a pivotally operating arm 20. The arm 20 is pivotally mounted on a rod 21 so that it is swung in the direction of the arrow e. The arm 20 has a solenoid 22 at one end. The lower end of the solenoid 22 is connected through a spring 24 to a frame 23. Before the solenoid 22 is energized, the arm 20 is maintained engaged with one of the pawls 18, 19.

The pressing roller drive device thus constructed operates as follows: Under the condition that the pressing roller 3 is contact with the fixing roller 1 as shown in FIG. 1, the cam 10 is not yet turned, and therefore the arm 20 is in engagement with the pawl 19 as shown in FIG. 3. Therefore, the power of the drive gear 13 is not transmitted to the cam shaft 11, which is running idle in the direction of the arrow c, while the clutch 15 races in the direction of the arrow c. It should be noted that the one-way clutch 15 is mounted on the cam shaft 11 so that only when the clutch 15 is turned clockwise with respect to the cam shaft 11, i.e., in a direction opposite to the direction of the arrow c, is the clutch 15 engaged with the cam shaft.

Thereafter, a sensor (not shown) provided near the fixing roller 1 produces a signal immediately before the rear edge of an image supporting sheet passes through the nip region of the fixing roller 1 and the pressing roller 3. By this signal, the solenoid 22 is energized, to move in the direction of the arrow f. As a result, the engaging end portion 20*a* of the pivotally moving arm 20 is turned downwardly about the rod 21, thus being disengaged from the pawl 19. Thereupon, the spring clutch 14 is operated, so that the drive gear 13 is coupled to the cam shaft 11 by the tightening force of the spring 17. In this operation, the pressing roller 3 is strongly abutted against the fixing roller 1, and therefore the fixing roller 1 reacts upon the pressing roller 3. As this reaction is exerted on the cam shaft 11 through the arm 7, a force acts on the cam shaft 11 so as to allow the cam shaft 11 to turn in the direction of the arrow c by itself, while the drive gear 13 intends to turn the cam shaft 11 in the direction of the arrow c. The speed of rotation of the cam shaft 11 owing to this force is higher than that of the drive gear 13; i.e., the cam shaft 11 turns faster than the drive gear 13. In this operation, the one-way clutch 15 coupled to the drive gear 13 is turned at the same speed as that of the drive gear 13. Relatively stating, the one-way clutch 15 is turned in a direction opposite to the direction in the above-described case; i.e., with the cam shaft 11 fixed, the one-way clutch 15 is turned in a direction opposite to the direction of the arrow c. Thus, the one-way clutch 15 is engaged with the cam shaft 11. As a result, the one-way clutch 15 brakes the rotation of the cam shaft 11, and therefore the cam 10 is not turned abruptly, i.e., it starts turning slowly. On the other hand, the solenoid 22 (FIG. 3) is energized instantaneously. In addition, the solenoid 22 is pulled downwardly by the spring 24. Accordingly, the engaging end portion 20*a* of the arm 20 is engaged next with the pawl immediately. Therefore, the cam 10 is turned through 180° in the direction of the arrow c and is then stopped, whereby the arm 7 is lowered, and the pressing roller 3 is thereby lowered to leave the fixing roller 1.

In the case where, in contrast to the above-described operation, the pressing roller 3 is brought into contact with the fixing roller 1, the sensor (not shown) provided near the fixing roller detects when the front edge of the image supporting sheet approaches the nip region of the fixing roller 1 and the pressing roller 3, to thereby produce a signal. In response to this signal, the solenoid is energized instantaneously, so that the front end portion 20*a* of the arm is disengaged from the pawl 18 or 19. Accordingly, the drive gear 13 is engaged with the cam shaft 11, so that the latter 11 is turned in the direction of the arrow c. In this case, no force is applied to the cam shaft 11, and therefore the cam shaft 11 is turned at the same speed as the drive gear 13. As the one-way clutch 15 is also turned at the same speed in the direction of the arrow c, the one-way clutch 15 will not reduce the torque of the cam shaft 11. The cam shaft 11 is turned only through 180° because the engaging end portion 20*a* of the arm 20 is immediately engaged with the next pawl 19 similarly as in the abovedescribed case. Accordingly, the cam 10 is turned through only 180° and returned to the position as indicated in FIG. 1.

As is apparent from the above description, according to the invention, the employment of the one-way clutch descreases the abrupt rotation of the cam shaft which may be caused in releasing the pressing roller from the fixing roller. Accordingly, the pressing roller drive device of the invention is effective in preventing damage to the device and the large noise which may otherwise be caused when the cam strikes the cam follower.

What is claimed is:

1. An apparatus for moving a pressing roller into and out of engagement with a fixing roller in a copying machine; said copying machine further comprising an arm coupled to a rotary shaft of said pressing roller and having a cam follower at one end which abuts against an eccentric cam provided to move said arm thereby moving said pressing roller into and out of engagement with said fixing roller, a cam shaft of said eccentric cam being rotated by a drive source; said apparatus comprising:

spring clutch means for transmitting drive power from said drive source to said cam shaft only when said clutch means is engaged;

means for periodically engaging said clutch means; and a one-way clutch coupled between said cam shaft and said drive source for maintaining the rotational speed of said cam shaft equal to the rotational speed imparted to said cam shaft by said drive source.

2. An apparatus as claimed in claim 1, further including a drive gear connected to a motor and a driven gear mounted upon said cam shaft, said clutch means comprising a spring clutch operating between said cam shaft and said drive gear.

3. An apparatus as claimed in claim 2, said one way clutch operating between said driven gear and said cam shaft.

4. An apparatus as claimed in claim 1, wherein said energizing means comprises a movable solenoid member, and an abutment member having one end in contact with said solenoid member.

5. An apparatus as claimed in claim 4, said abutment member having an abutment surface, means for disengaging said clutch means being engageable with said abutment surface when said solenoid member is in a first position.

6. An apparatus as claimed in claim 5, said abutment member comprising a lever pivotable to disengage said abutment surface and said clutch disengagement means when said solenoid moves to a second position.

* * * * *